United States Patent [19]

Kawasaki et al.

[11] Patent Number: 4,969,384

[45] Date of Patent: Nov. 13, 1990

[54] MUSICAL SCORE DURATION MODIFICATION APPARATUS

[75] Inventors: Shingo Kawasaki; Takashi Hirakata; Hitoshi Makita; Takuya Nakata, all of Hamamatsu, Japan

[73] Assignee: Yamaha Corporation, Hamamatsu, Japan

[21] Appl. No.: 370,388

[22] Filed: Jun. 22, 1989

[30] Foreign Application Priority Data

Jun. 23, 1988 [JP] Japan ..... 63-155630

[51] Int. Cl.[5] ..... G10H 1/40; G10H 7/00

[52] U.S. Cl. ..... 84/612; 84/636; 84/DIG. 12

[58] Field of Search ..... 84/609–612, 84/634–636, 649–652, 666–668, DIG. 12; 360/8

[56] References Cited

U.S. PATENT DOCUMENTS 4,376,874 3/1983 Karban et al. ..... 360/8 X
4,881,440 9/1989 Kakizaki ..... 84/649 X

OTHER PUBLICATIONS

Zicarelli, David, "*M and Jam Factory*", Computer Music Journal, vol. 11, No. 4, Winter 1987, Massachusetts Institute of Technology, pp. 13–29.

*Primary Examiner*—A. D. Pellinen
*Assistant Examiner*—Brian Sircus
*Attorney, Agent, or Firm*—Spensley Horn Jubas & Lubitz

[57] ABSTRACT

An automatic performance apparatus that can change the performance speed of desired sections in a piece of music automatically performed. The apparatus comprises a section designator for designating a specific section in the piece, a time evaluator for counting performance duration of the piece, a modifier for modifying either the duration of the specific section (or the duration of a section other than the specific section) by modifying the tempo of the automatic performance or duration of notes of the performance data so that the performance duration of the automatic performance becomes equal to the desired duration. Thus, the total duration of the piece is adjusted to the desired duration while maintaining the duration of the specified section (or the duration of the sections other than the specified section).

7 Claims, 13 Drawing Sheets

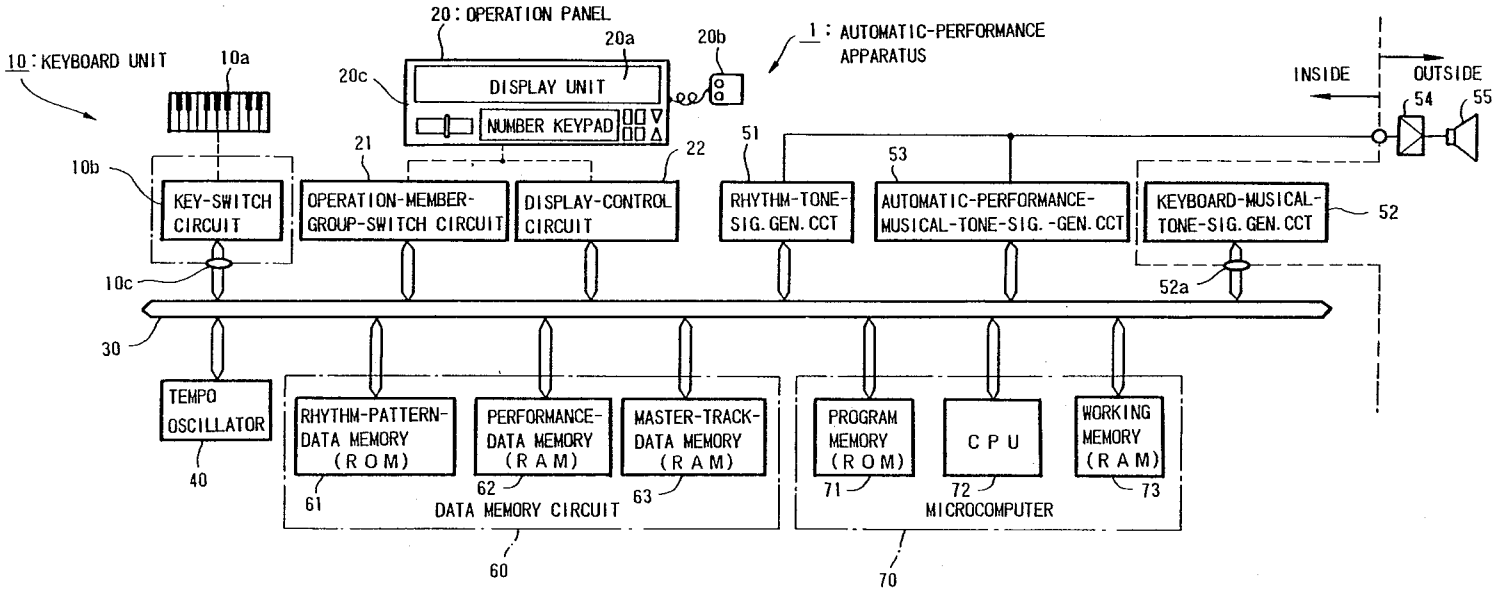
FIG. 2 (EMBODIMENT)

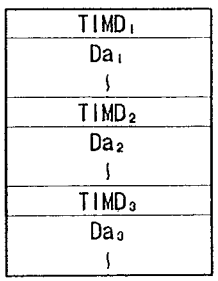
FIG. 3B (EXAMPLE OF A SERIES OF PERFORMANCE DATA)
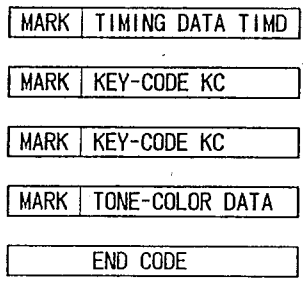
FIG. 3A (DATA FORMAT OF PERFORMANCE DATA)

| | | | |
|---|---|---|---|
| TIME DATA | ID | NUMERATOR | DENOMINATOR |
| TEMPO DATA | ID | TEMPO DATA | |
| STEP DATA | ID | STEP DATA | |
| REHEARSAL MARK | ID | NUMBER | Fix/Float |
| END MARK | END | | |

FIG. 4A (DATA FORMAT OF MASTER-TRACK DATA)

| | | |
|---|---|---|
| TIME DATA | 4 | 4 |
| REHEARSAL MARK | 1 | Fix |
| TEMPO DATA | ♩ =120 | |
| STEP DATA | 48 | |
| TEMPO DATA | ♩ =122 | |
| STEP DATA | 48 | |
| REHEARSAL MARK | 2 | Float |
| TEMPO DATA | ♩ =125 | |
| STEP DATA | 96 | |
| END MARK | END | |

FIG. 4B (EXAMPLE OF A SERIES OF MASTER-TRACK DATA)

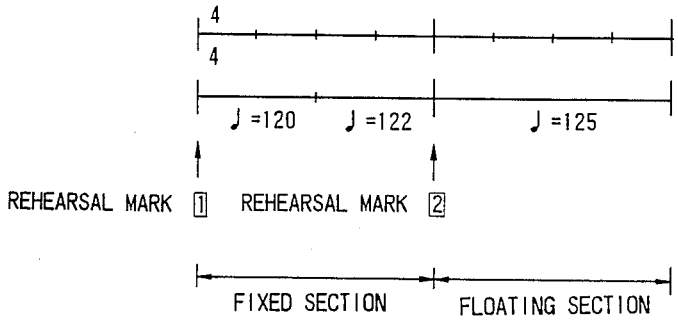

FIG. 4C (PERFORMANCE TEMPO)

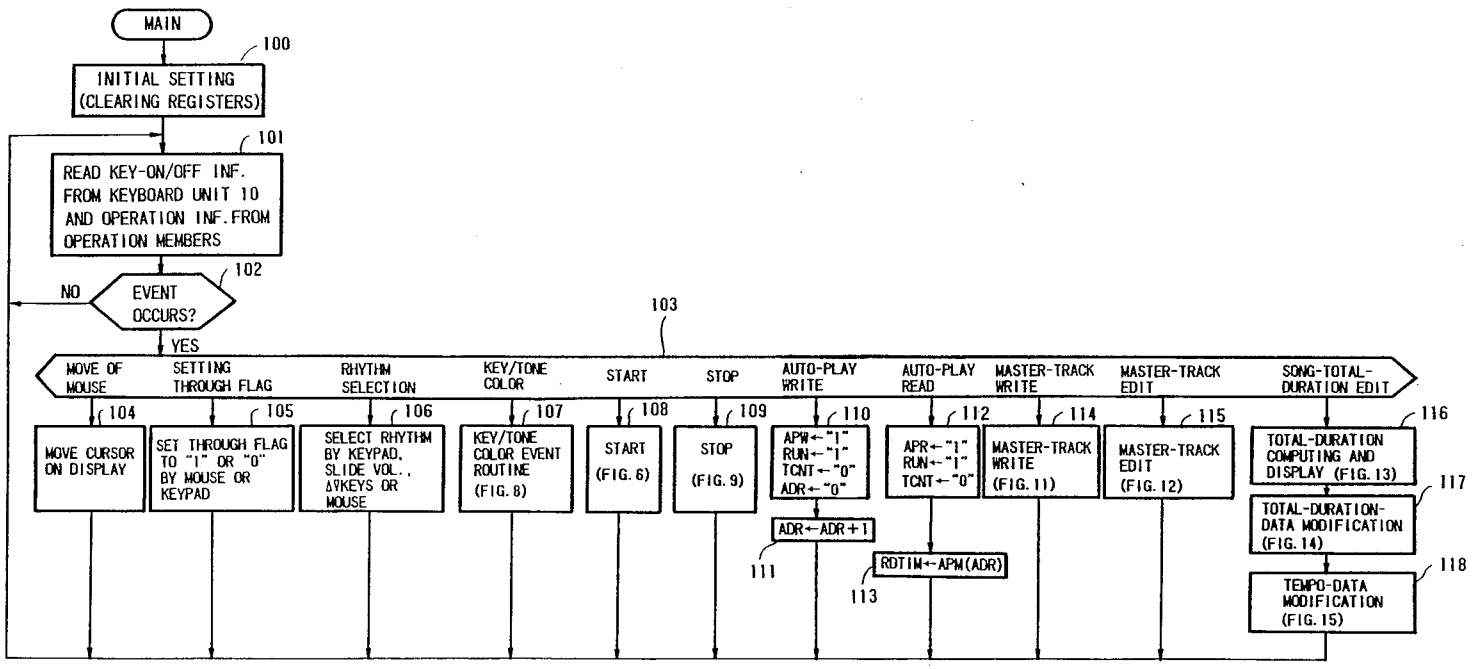
FIG. 5 (MAIN ROUTINE)

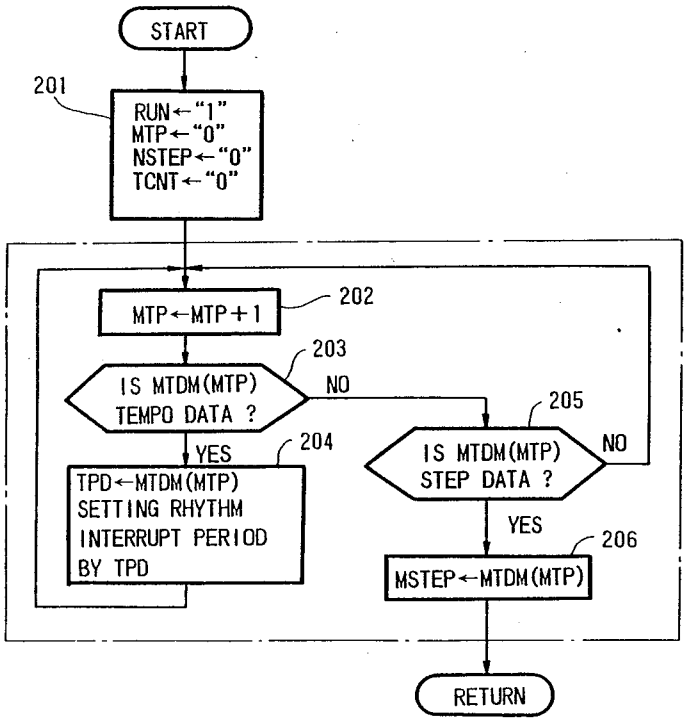
FIG. 6 (START ROUTINE)
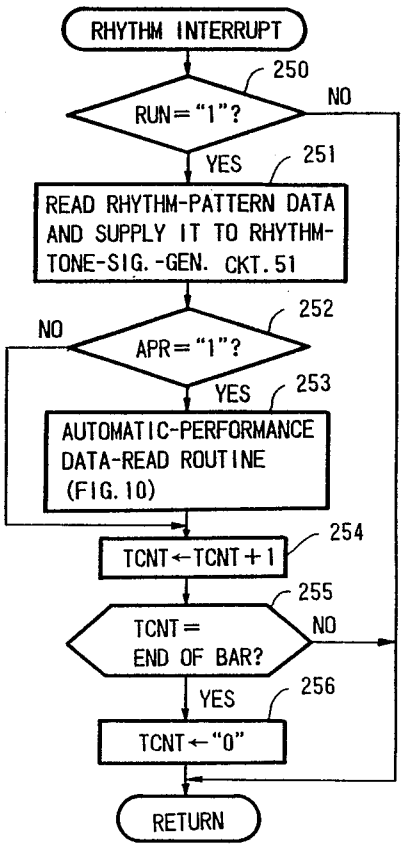
FIG. 7 (RHYTHM INTERRUPT ROUTINE)

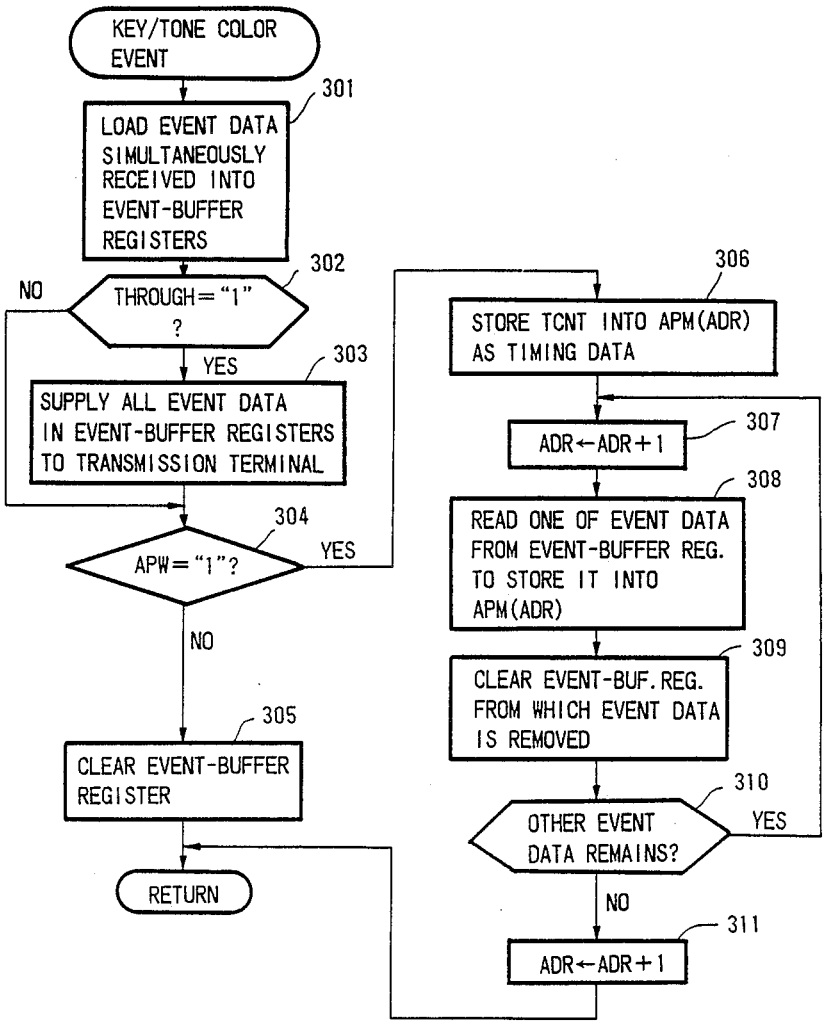
FIG. 8 (KEY/TONE-COLOR-EVENT ROUTINE)

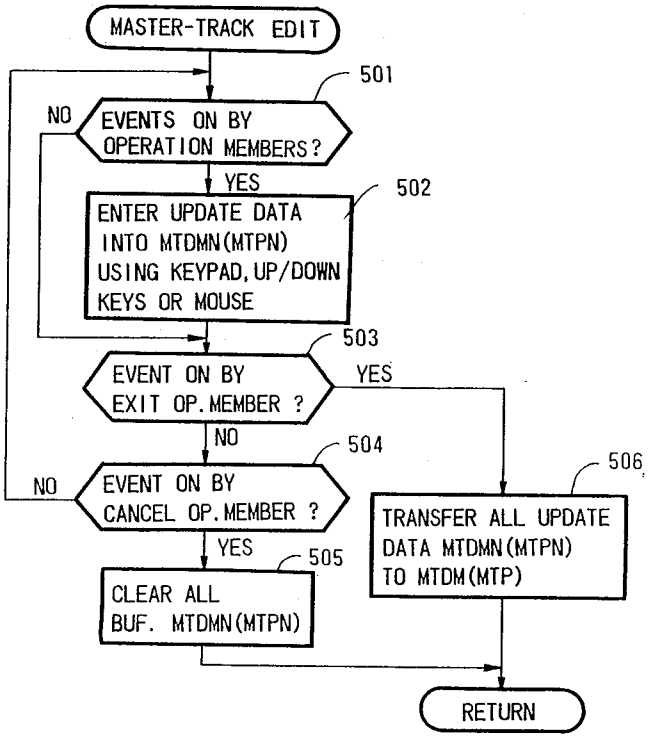
FIG. 12 (MASTER-TRACK-EDIT ROUTINE)
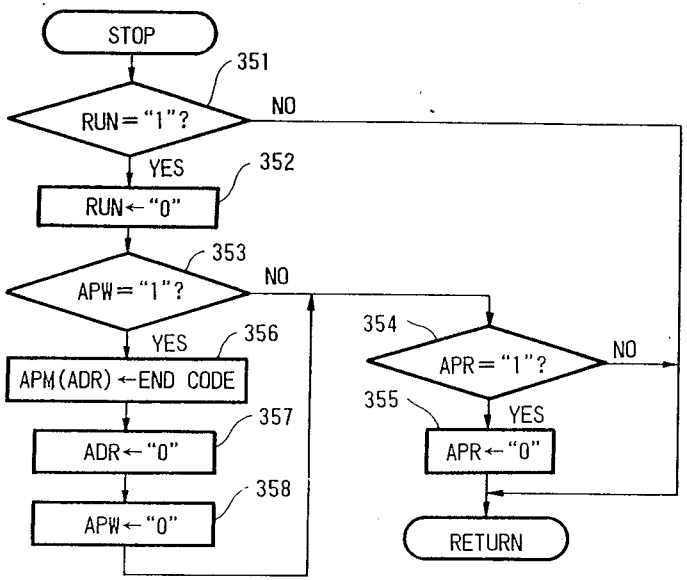
FIG. 9 (STOP ROUTINE)

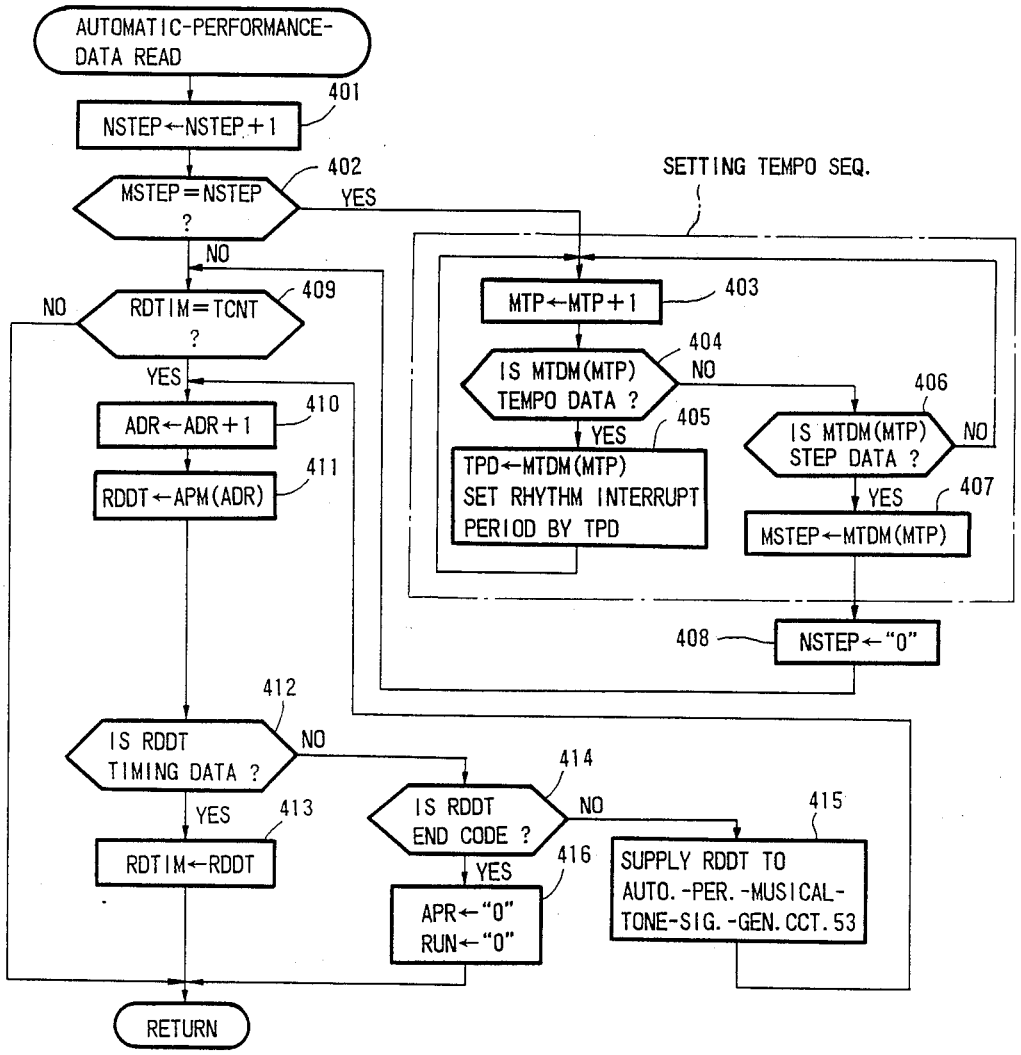
FIG.10 (AUTOMATIC-PERFORMANCE-DATA-READ ROUTINE)

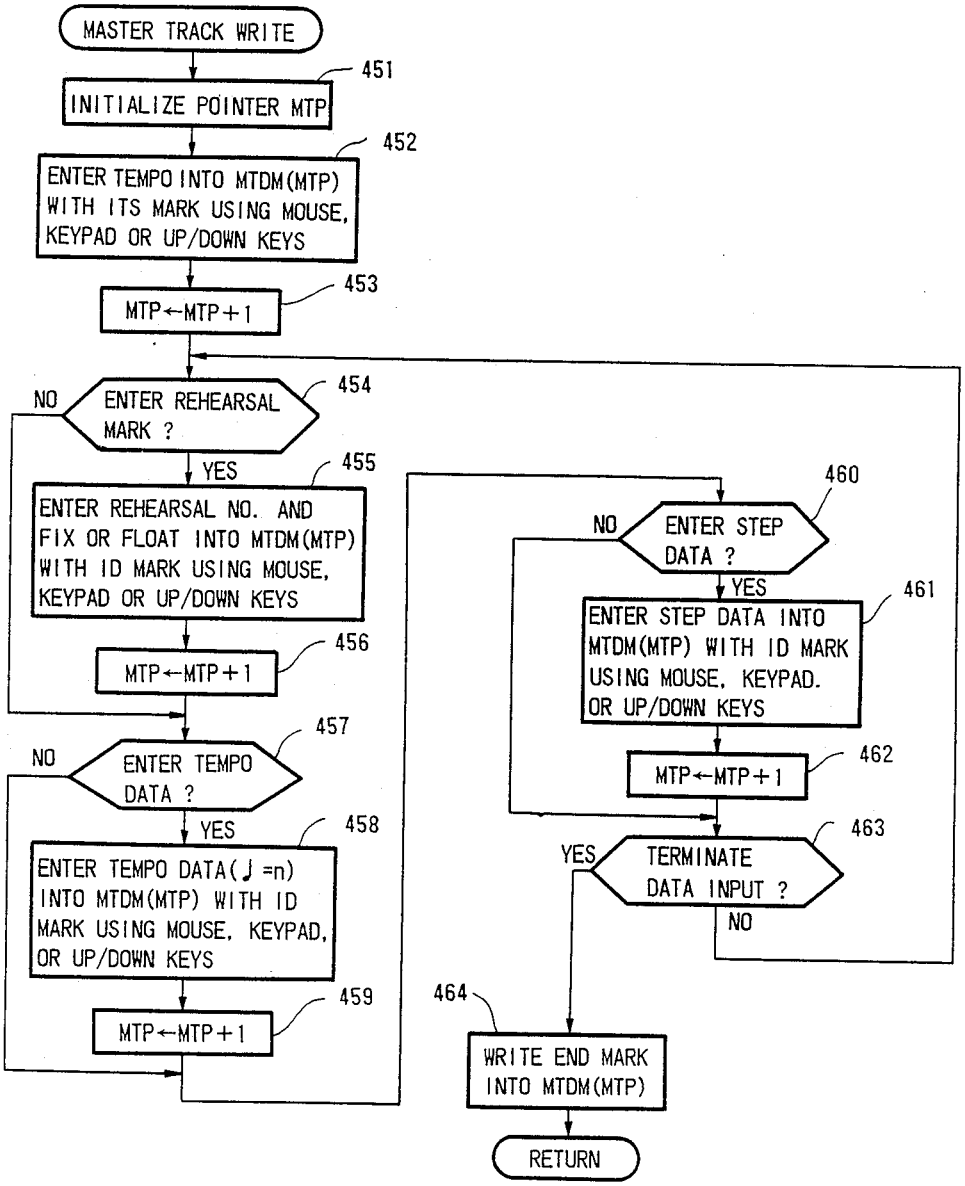
FIG.11 (MASTER-TRACK-WRITE ROUTINE)

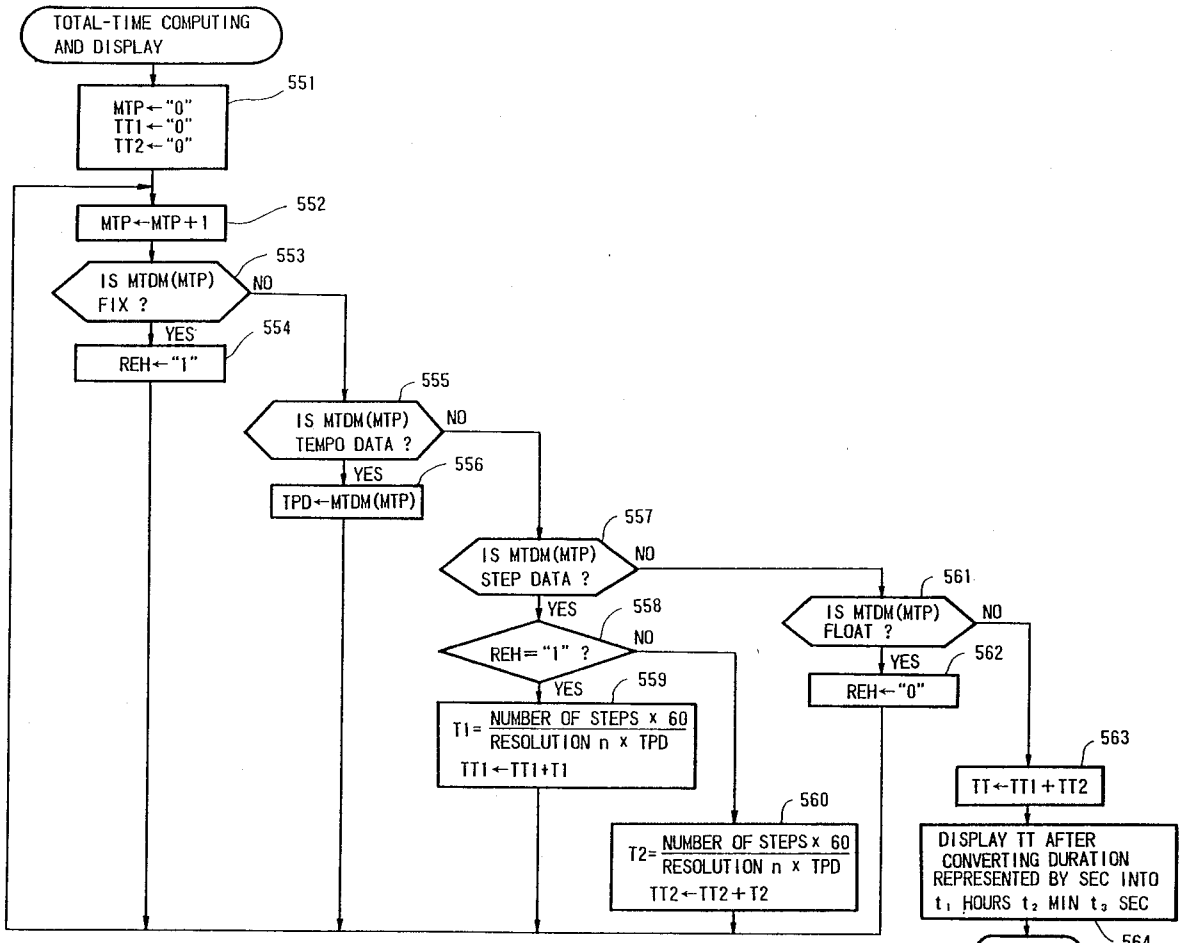
FIG. 13 (TOTAL-DURATION-COMPUTING-AND-DISPLAY ROUTINE)

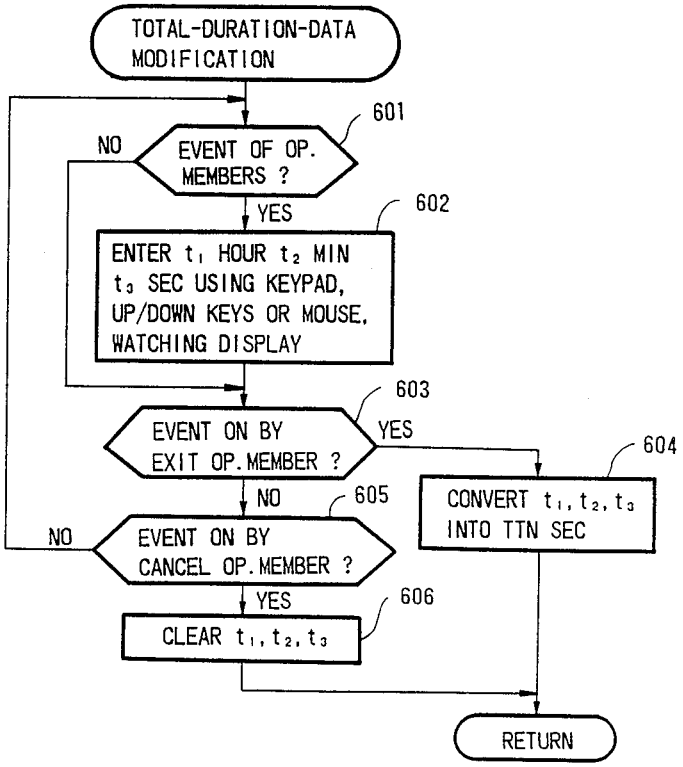
FIG.14 (TOTAL-DURATION-DATA-MODIFICATION ROUTINE)

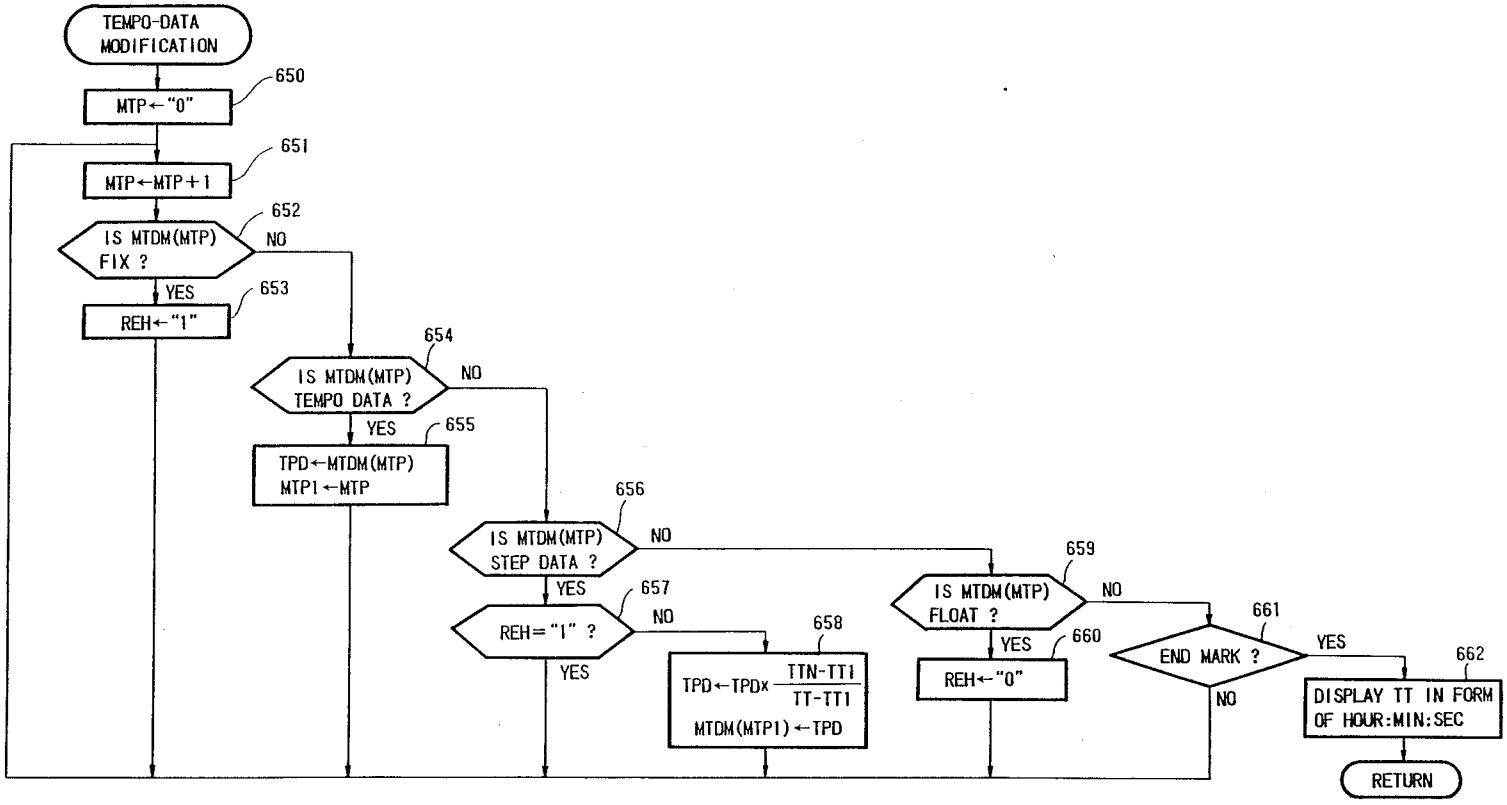
FIG.15 (TEMPO-DATA-MODIFICATION ROUTINE)

MUSICAL SCORE DURATION MODIFICATION APPARATUS

BACKGROUND OF THE INVENTION

1. Field of the Invention

The present invention relates to an automatic performance apparatus that can change the performance duration of a piece of music.

2. Prior Art

An automatic performance apparatus which stores performance data of a piece of music into a performance data memory, and automatically performs the piece by sequentially reading the data from the memory, has been developed.

Among these types of automatic performance apparatuses, there are some that can shorten or lengthen the performance duration of a piece: for example, "Model 4050 Autolocator/performance-duration-and-tempo-management sequencer" of Fostex Cooperation in Japan is known. These types of automatic performance apparatuses are used for performing pieces of predetermined duration, for instance, sound track music of a cinema film or commercial music on TV which are connected with visual images.

In the sound track music, a piece of music is divided into a number of performance sections, and these sections are successively assigned to consecutive scenes of a film so that the scenes and the music are synchronized. Generally speaking, the total duration of scenes and that of music do not match, and hence, the performance duration must be adjusted.

The conventional automatic performance apparatus mentioned above, however, adjusts the performance duration only by uniformly regulating the reproduction speed of the piece as shown in FIG. 1A. In FIG. 1A, for example, the former performance duration Ta1 and the latter performance duration Tb1 are uniformly shortened to duration Ta2 and duration Tb2, respectively. Thus, the conventional apparatus can only uniformly shorten or lengthen the performance sections. Consequently, duration adjustment as shown in FIG. 1B is impossible: the duration adjustment, in which the duration Ta1 of the former performance section assigned to one scene is maintained Ta1, while the duration Tb1 of the latter performance section is shortened to Tb2 so that the total duration is matched to the desired duration, is difficult. When the adjustment shown in FIG. 1B is inevitable, the reproduction speed must be changed by external operation during the performance. The operation, however, is very difficult and cannot achieve the adjustment of the total performance duration.

The adjustment in a manner shown in FIG. 1B is also required in the following case: the alteration of the tempo of a piece sometimes changes the expression or image of the piece; and some sections may have more impact than others, giving a disharmonious feeling to the audience, while other sections scarcely affect the image when the performance speed thereof is changed. Hence, it is desired that the tempo of the sections which scarcely affect the image of the piece is modified, while the tempo of the other sections is maintained The adjustment shown in FIG. 1B can be applied in such a case.

SUMMARY OF THE INVENTION

It is therefore an object of the present invention to provide an automatic performance apparatus that can easily and precisely adjust the total performance duration to a predetermined length, without changing the duration of the specified performance sections.

In one aspect of the present invention, there is provided an automatic performance apparatus having performance-data-memory means which stores performance data of a piece of music, and automatically performing the piece of music by sequentially reading the performance data from the performance-data-memory means, the automatic performance apparatus comprising:

section-designation means for designating a specific section in the piece;

time-evaluating means for counting performance duration of the piece;

performance-duration-modification-designation means for designating performance duration of the piece; and modification means for modifying either the duration of the specific section or the duration of a section other than the specific section by modifying the tempo of the automatic performance or duration of notes of the performance data according to the performance duration counted by the time-evaluating means and the performance duration designated by the performance-duration-modification-designation means, so that the performance duration of the automatic performance becomes equal to the performance duration designated by the performance-duration-modification-designation means.

BRIEF DESCRIPTION OF THE DRAWINGS

FIG. 2 is a block diagram of an electrical configuration of an automatic performance apparatus according to an embodiment of the present invention;

FIG. 3A is a pictorial view showing arrangement of automatic performance data;

FIG. 3B is a pictorial view showing arrangement of a series of the automatic performance data;

FIG. 4A is a pictorial view showing arrangement of master-track data of the embodiment;

FIG. 4B is a pictorial view showing arrangement of a series of the master-track data of the embodiment;

FIG. 4C is a pictorial view showing an example of performance sections and tempos thereof corresponding to the data shown in FIG. 4B;

FIG. 5 is a flowchart of the main routine of the embodiment;

FIG. 6 is a flowchart of the start routine of the embodiment;

FIG. 7 is a flowchart of the rhythm-interrupt routine of the embodiment;

FIG. 8 is a key/tone-color event routine of the embodiment;

FIG. 9 is a flowchart of the stop routine of the embodiment;

FIG. 10 is a flowchart of the automatic-performance-data-read routine of the embodiment:

FIG. 11 is a flowchart of the master-track-write routine of the embodiment;

FIG. 12 is a flowchart of the master-track-edit routine of the embodiment;

FIG. 13 is a flowchart of the total-duration-computing-and-display routine;

FIG. 14 is a flowchart of the total-duration-data-modification routine of the embodiment; and FIG. 15 is a flowchart of the tempo-data-modification routine.

DESCRIPTION OF THE PREFERRED EMBODIMENTS

Figure 1A:
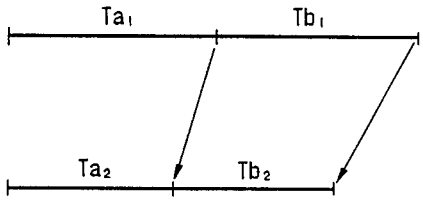
FIG.1 A (PRIOR ART)
FIG. 1A is a schematic view showing a method for adjusting the performance duration in a conventional automatic performance apparatus.
Figure 1B:
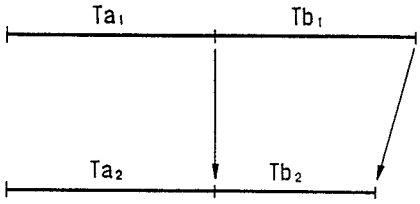
FIG. 1B is a schematic view showing a method for adjusting the performance duration which cannot be achieved by the conventional automatic performance apparatus.

The invention will now be described with reference to the accompanying drawings.

CONFIGURATION OF AN EMBODIMENT

FIG. 2 is a block diagram showing a configuration of an electronic-musical instrument that includes an automatic performance apparatus according to an embodiment of the present invention.

The electronic-musical instrument comprises keyboard unit 10, keyboard-musical-tone-signal-generating circuit 52 for keyboard 10*a*, and a external sound system having amplifier 54 and speaker 55, as well as automatic-performance apparatus 1.

Keyboard unit 10 consists of keyboard 10*a* and key-switch circuit 10*b*. Keyboard 10*a* has a plurality of keys under which are provided key switches for detecting operations of each key. Key-switch circuit 10*b* detects the on/off state of each key switch, and produces key-on/off information which indicates the key depression or key release according to the detection result. The key-on/off information is sent to bus 30 in automatic performance apparatus 1 via receiving terminal 10*c*. Keyboard-musical-tone-signal-generating circuit 52 is provided with a plurality of musical-tone-signal-generating channels that generate musical-tone signals corresponding to musical instruments such as a piano, violin, flute, etc., and produces musical-tone signals according to key operation on keyboard 10*a*. The musical-tone signals produced from keyboard-musical-tone-signal-generating circuit 52 are mixed with the musical-tone signals from rhythm-tone-signal-generating circuit 51 and automatic-performance-musical-tone-signal-generating circuit 53, and are supplied to amplifier 54. Amplifier 54 is connected with speaker 55 which produces musical-tones corresponding to the musical-tone signals supplied from amplifier 54.

Next, the configuration of automatic performance apparatus 1 will be described.

This automatic performance apparatus 1 comprises operation panel 20, tempo oscillator 40, rhythm-tone-signal-generating circuit 51, automatic-performance-musical-tone-signal-generating circuit 53, data-memory circuit 60 and microcomputer 70, all of which are connected to one another through bus 30.

Operation panel 20 is provided with display unit 20*a*, operation members 20*c* having a number-keypad, sliding volume controls, up/down keys, etc., together with mouse 20*b*. Display unit 20*a* is connected with display-control circuit 22 that receives display information supplied via bus 30, and displays the information through display unit 20*a*. Operation panel 20 is also connected with operation-member-group-switch circuit 21 that detects various operations when operation members 20*c* or mouse 20*b* is operated and supplies the detection information to bus 30. These piece of detection information include rhythm data (such as 8 beats or samba), tone-color data (such as a piano or a flute), volume adjustment data of musical tones to be generated, tempo adjustment data of musical tones to be generated, data indicating the start of an automatic performance or the start of recording of the performance data, data indicating the stop of the automatic performance or the stop of recording of the performance data, etc..

Tempo oscillator 40 produces rhythm-interrupt signals (tempo clock pulses) according to a predetermined tempo, and supplies the tempo clock pulse to microcomputer 70 via bus 30. Rhythm-tone-signal-generating circuit 51 has a plurality of percussion-instrument-signal-generating circuits that generate percussion-instrument signals corresponding to percussion instruments (such as cymbals, bass drums, bongos, etc.), according to rhythm-pattern data supplied from microcomputer 70 via bus 30. Automatic-performance-musical-tone-signal-generating circuit 53 is provided with a number of musical-tone-signal-generating channels that generate musical-tone signals corresponding to musical instruments (such as pianos, violins, flutes, etc.), according to the performance data supplied from microcomputer 70 by way of bus 30. The performance data are stored in data-memory circuit 60 and are consecutively read therefrom, being supplied to automatic-performance-musical-tone-signal-generating circuit 53.

Data-memory circuit 60 consists of rhythm-pattern-data memory 61, performance-data memory 62, and master-track-data memory 63, each of which is connected with bus 30. Rhythm-pattern-data memory 61 is a ROM which stores rhythm-pattern data in one bar according to the time sequence for each rhythm pattern. Performance-data memory 62 is a RAM which stores automatic-performance data APM(ADR) in a number of memory locations designated by address data ADR. The automatic-performance data, which are stored in performance-data memory 62 in formats shown in FIG. 3A, includes the following data:

Timing Data

Timing data consists of an identification mark thereof, and timing data TIMD denoting elapsed time from the beginning of a bar.

Depressed-key Data

Depressed-key data consists of an identification mark denoting that the data is event data relating to a depressed key on keyboard 10*a*, and key-code KC representing a depressed key.

Released-Key Data

Released-key data consists of an identification mark denoting that the data is event data relating to a released key on keyboard 10*a*, and key-code KC representing a released key.

Tone-Color Data

Tone-color data consists of an identification mark thereof, and tone-color data indicating a selected tone color.

End Code

End code indicates the terminus of an automatic performance.

These automatic-performance data are sequentially stored in performance-data memory 62 in the form shown in FIG. 3B: each timing data TIMDi (i=1, 2, 3, . . . ) is paired with automatic-performance data Dai controlling the performance executed at the timing designated by the timing data TIMDi, and the pairs are stored sequentially.

Master-track-data memory 63 is a RAM that stores master-track data MTDM(MTP) in a number of memory locations designated by master-track pointer MTP. Master-track data includes the following data which are stored in master-track-data memory 63 in the format shown in FIG. 4A.

Time Data

Time data consists of identification mark ID thereof, and a numerator and denominator of the time.

Tempo Data

Tempo data consists of identification mark ID thereof, and tempo data that indicates the rate of the tempo clock pulses of tempo oscillator 40. The tempo data denotes the repetition number of a quarter note in a minute when the tempo clock pulse defined by the tempo data is used.

Step Data

Step data consists of identification mark ID thereof, and step data. The step data indicates the number of the tempo clock pulses to be produced before the setting of the next tempo data (i.e., tempo-clock pulses produced in a section).

Rehearsal Mark

A rehearsal mark consists of an identification mark ID thereof, a rehearsal mark number, and the designation "Fix"/"Float". When the "Fix" of the Fix/Float designation is selected, the tempo data stored below the rehearsal mark "Fix" in the master-track-data memory 63, are not modified by tempo-data-modification process described below. On the other hand, when the "Float" of the Fix/Float designation is selected, the tempo data stored below the rehearsal mark "Float" in the master-track-data memory 63, are modified by tempo-data-modification process described below.

END Mark

END mark designates the terminal of the master-track data.

FIG. 4B shows an example of arrangement of stored data in master-track-data memory 63, and FIG. 4C shows the performance tempo when an automatic performance is executed according to the master-track data shown in FIG. 4B. The automatic performance according to the master-track data in FIG. 4B is executed as follows. First, the automatic performance starts with four crotchets (4/4) time in accordance with time data. The performance is carried out for the duration of 48 tempo clock pulses at a speed corresponding to the tempo data of "120", and then, for the duration of 48 tempo clock pulses at a speed corresponding to the tempo data of "122", and at last, for the duration of 96 tempo clock pulses at a speed corresponding to the tempo data "125", thus completing the performance. During the sections in which the tempo data are "120" and "122", "Fix" is designated by the rehearsal mark (No. 1), so that the modification of the tempo data by the program is inhibited. In the last section in which the tempo data is "125", "Float" is designated by the rehearsal mark (No. 2), so that the modification of the tempo data by the program is allowed.

Referring to FIG. 2 again, microcomputer 70 consists of program memory 71, CPU 72 and working memory 73, all of which are interconnected by bus 30. Program memory 71 is a ROM that stores the main routine, rhythm-interrupt routine, and the subprograms thereof, etc.. CPU 72 initiates the main routine when the power switch (not shown) is turned on, and runs the routine repeatedly until the power switch is turned off. CPU 72 interrupts the main routine and executes the rhythm interrupt routine each time the tempo clock pulse from tempo oscillator 40 causes an interrupt. Working memory 73 is a RAM that temporarily stores various data and flags used during the execution of the program. The main data among those are as follows:

Rhythm-Run Flag RUN

When rhythm-run flag RUN is set to "1", a rhythm tone is generated, whereas when rhythm-run flag RUN is reset to "0", the rhythm tone is stopped.

Auto-Play-Write Flag APW

When auto-play-write flag APW is set to "1", the performance data from keyboard unit 10 is written into performance-data memory 62.

Auto-Play-Read Flag APR

When auto-play-read flag APR is set to "1", the performance data in performance-data memory 62 is read sequentially therefrom to execute the automatic performance, whereas when auto-play-read flag APR is reset to "0", the automatic performance is stopped.

Through Flag THROUGH

When through flag THROUGH is set to "1", keyboard-musical-tone-signal-generating circuit 52 generates the musical-tone signals based on the operation of keyboard 10*a*. When through flag THROUGH is reset to "0", keyboard-musical-tone-signal-generating circuit 52 generates no musical-tone signal even if keyboard 10*a* is operated.

Address Data ADR

Address data ADR that designates the address of performance-data memory 62 is supplied to the address terminal thereof.

Tempo Counter TCNT

Tempo counter TCNT is incremented each time a tempo clock pulse is produced from tempo oscillator 40, and is reset to "0" when the content of the tempo counter reaches "96", thus repeatedly counting tempo clock pulses from "0" to "95". Tempo counter TCNT indicates the elapsed time in each bar during automatic performance, and a tempo count of "96" (=0) indicates the timing on each bar line.

Read Data RDDT

Read data RDDT are retrieved from performance-data memory 62.

Read-Timing Data RDTIM

Read-timing data RDTIM is timing data contained in performance data read from performance-data memory 62.

Data MSTEP

Data MSTEP is provided for containing step data read from master-track-data memory 63.

Step-Counter NSTE

Step-counter NSTEP is incremented each time the tempo-clock pulse is applied from tempo oscillator 40. When the value of step-counter NSTEP reaches the value of step-data MSTEP, the next, new tempo-setting process is executed and step-counter NSTEP is cleared to "0".

Rehearsal Flag REH

Rehearsal flag REH is set to "1" when the rehearsal mark is "Fix", while it is set to "0" when the rehearsal mark is "Float".

Data TPD

Data TPD is provided for containing the tempo data read from master-track-data memory 63 and indicates a rate at which tempo oscillator 40 oscillates.

Fixed-Performance-Duration Data T1

Fixed-performance-duration data T1 indicates the performance duration corresponding to a rehearsal section in the master-track data. A rehearsal section is set to "Fix" by the rehearsal mark, so that the tempo data of the section cannot be modified by the program.

Total-Fixed-Performance-Duration Data TT1

Total-fixed-performance-duration data TT1 contains the sum total of fixed-performance-duration data T1 of all the rehearsal (fixed) sections in the entire master-track data.

Floating-Performance-Duration Data T2

Floating-performance-duration data T2 indicates the performance duration corresponding to a floating section (a section other than the rehearsal sections) in the master-track data.

Total-Floating-Performance-Duration Data TT2

Total-floating-performance-duration data TT2 contains the sum total of floating-performance-duration data T2 in the entire master-track data.

OPERATION OF THE EMBODIMENT

The operation of the electronic musical instrument according to the embodiment will be described referring to the flowcharts shown in FIG. 5 to FIG. 15.

(1) NORMAL PERFORMANCE MODE

The electronic musical instrument operates in a Normal Performance Mode when operation panel 20 is not operated after the power switch (not shown) is turned on. In the Normal Performance Mode, keyboard-musical-tone-signal-generating circuit 52 produces musical-tone signals according to the operation of keyboard unit 10.

More specifically, when the power switch is turned on, CPU 72 initiates the main program shown in FIG. 5, and initializes microcomputer 70 by clearing the registers and flags in working memory 73 at step 100. Completing the initialization, CPU 72 scans the key-switches in key-switch circuit **10*b* as well as the operation switches in operation-member-switch circuit 21, and reads the key-on/off information from keyboard unit 10 as well as the operation information from operation panel 20 by wa of bus 30 at step 101. Then, at step 102, CPU 72 detects the presence of a key-on/off event in keyboard unit 10 or an operation event in operation panel 20 on the basis of the key-on/off information and operation information using working memory 73. If no operation is detected, that is, no key on keyboard unit 10 or no operation member on operation panel 20 is operated, CPU 72 judges that no event has occurred ("NO") at step 102 and loops back to step 101, thus continuing the loop composed of steps 101 and 102**.

The electronic musical instrument also has mouse **20*b* as an operation device. The operation information is entered from mouse 20*b* as follows: first, the operation menu is shown on display unit 20*a* of operation panel 20; when the performer moves mouse 20*b*, a mouse-movement event is detected at steps 101 and 102, and the process proceeds to step 104 according to the test result at step 103; at step 104, CPU 72 supplies display information to display-control circuit 22 via bus 30 according to the mouse-movement event detected above. As a result, the movements of mouse 20*b* correspond to cursor movements on display unit 20*a*. Thus, when the performer moves mouse 20*b*, the movement is detected by CPU 72 and the current position of mouse 20*b* is always indicated by the cursor on display unit 20*a*. The performer moves mouse 20*b* watching display unit 20*a*, and places the cursor over the desired operation menu, and clicks the button provided on mouse 20*a* or operates an operation member of operation-member group 21*c*. Thus, the operation event is detected at steps 101 and 102**, and a predetermined process is executed for each event.

When the performer plays in the Normal Performance Mode, he first selects the rhythm: he places the cursor of mouse **20*b* on "Rhythm Selection" in the operation menu displayed on display unit 20*a* and clicks mouse 20*b*. As a result, the rhythm-selection-request event is detected at steps 101 and 102, and the program proceeds to step 106 by way of step 103. At step 106, CPU 72 supplies the display information to display-control circuit 22 via bus 30 and the rhythm-selection menu is displayed on display unit 20*a*, and then CPU 72 waits for rhythm selection designation. Moving mouse 20*b*, the performer places the cursor on a desired rhythm indication on the display unit 20*a*, and clicks mouse 20*b*. As a result, rhythm-specification information is supplied to CPU 72 from operation panel 20 via operation-member-switch circuit 21 and bus 30**, thus completing the rhythm selection.

To start the rhythm selected, the performer manipulates operation panel 20 and commands CPU 72 to start the rhythm. CPU 72 detects the rhythm-start-request event at steps 101 and 102 and proceeds to step 108 via step 103. At step 108, the start routine is initiated.

FIG. 6 is the flowchart of the start routine. At step 201 in FIG. 6, flag RUN is set to "1", whereas tempo counter TCNT, master-track-pointer MTP and step-counter NSTEP are set to "0". At step 202, master-track pointer MTP is incremented by 1. At step 203, the data designated by master-track pointer MTP in master-track-data memory 63 (the data is called master-track data MTDM(MTP) hereafter) is tested whether it is tempo data or not. If the test result is "YES" the process proceeds to step 204; if the result is "NO" the process proceeds to step 205. At step 204, master-track data MTDM(MTP) is set into data TPD. As a result, the rate of tempo clock pulses (that is, the period of the generation of the rhythm interrupt) produced by tempo oscillator 40 is set, and CPU 72 loops back to step 202. At step 205, on the other hand, a test is performed to determine whether master-track data MTDM(MTP) is step data or not. If the test result at step 205 is "NO", the process loops back to step 202; if the result is "YES", the process proceeds to step 206. At step 206, master-track data MTDM(MTP) is set into data MSTEP, and the start routine is completed. Thus, in the start routine, the initial tempo data and step data are read from master-track-data memory 63, and are set into data TPD and MSTEP. In addition, rhythm-run flag RUN is set to "1". When the start routine has been completed, CPU 72 exits the routine and returns to the main routine in FIG. 5.

When the tempo clock pulse produced from tempo oscillator 40 is supplied to CPU 72 as the rhythm-interrupt-request signal, CPU 72 initiates the rhythm-interrupt routine shown in FIG. 7. At step 250 in FIG. 7, rhythm-run flag RUN is tested to determine if it is "0" or not. If the test result is "YES", the process proceeds to step 251, whereas if the test result is "NO", the process exits the routine and returns to the main routine in FIG. 5. In this case, since the test result at step 250 is "YES", the process proceeds to step 251 where the element of the selected rhythm-pattern data, the element which is pointed by tempo counter TCNT is read from rhythm-pattern memory 61, and is supplied to rhythm-tone-signal-generating circuit 51 which generates rhythm tones according to the rhythm-pattern data. At step 252, auto-play-read flag APR is tested to determine if it is "1" or not. Since the test result is "NO" in this case, the process proceeds to step 254 where tempo counter TCNT is incremented by 1. At step 255, the content of tempo counter TCNT is tested whether it reaches the end value in a bar ("96" in this electronic musical instrument). If the test result is "YES", the process proceeds to step 256, whereas if the result is "NO", CPU 72 exits the routine and returns to the main routine in FIG. 5. At step 256, tempo counter TCNT is cleared and the routine is completed. Hence, CPU 72 returns to the main routine in FIG. 5.

When the performer operates keyboard unit 10, a key-operation event is detected at steps 101 and 102 of the main routine in FIG. 5, and the process proceeds to step 107 by way of step 103. At step 107, the key/tone-color event shown in FIG. 8 is executed. First, at step 301, all event data which are simultaneously received from keyboard unit 10 are loaded into the event-buffer registers in working memory 73. At step 302, flag THROUGH is tested whether it is "1" or not.

Flag THROUGH is used to switch the circuit that generates musical tones when key-operation event is detected: whether keyboard-musical-tone-signal-generating circuit 52 generates musical tones or not. More specifically, the electronic-musical instrument can be connected not only to keyboard unit 10 but also to an external electronic-musical instrument capable of generating musical tones. When the external electronic-musical instrument is connected, the performance data therefrom of MIDI (Musical Instrument Digital Interface) standard can be stored in performance-data memory 62 so that the data can be used for the automatic performance by the external instrument. In such a case, the musical tones corresponding to the supplied performance data are produced by the external electronic-musical instrument, and so it is not necessary to generate musical tones in keyboard-musical-tone-signal-generating circuit 52. This is the reason the electronic-musical instrument of the embodiment is provided with the THROUGH flag so that keyboard-musical-tone-signal-generating circuit 52 can be switched to generate or not to generate the musical tones. The performer can set the THROUGH flag by manipulating operation panel 20: when the performer enters the request for setting the THROUGH flag from operation panel 20, the request is detected at steps 101 and 102 of the main routine in FIG. 5, and the process proceeds to step 105 via step 103. Seeing the THROUGH-flag-setting screen on display unit 20*a*, the performer sets the THROUGH flag to "1" or to "0" by moving mouse 20*b* or by operating the keypad in operation-member group 20*c*.

Referring to FIG. 8 again, if the test result at step 302 is "YES", the process proceeds to step 303, while if the result is "NO" the process proceeds to step 304. At step 303, all the event data in the event-buffer registers are supplied via transmission terminal 52*a* to keyboard-musical-tone-signal-generating circuit 52, which generates musical tones according to the operation on keyboard unit 10. At step 304, auto-play-write flag APW is tested whether it is "1" or not. Since the test result is "NO" in this case, the process proceeds to step 305 at which the event-buffer registers are cleared. Thus, the key/tone-color-event routine is completed, and the process returns to the main routine in FIG. 5.

The key/tone-color-event routine in FIG. 8 is also executed when the operation member for selecting a tone color in operation panel 20 is operated, and the event data of the operation is supplied to keyboard-musical-tone-signal-generating circuit 52, so that the tone colors of musical-tone signals generated therein are controlled. Thus, each time the operation member for setting a tone color on keyboard unit 10 and/or in operation panel 20 is operated, key/tone-color-event routine is carried out, and the musical tones corresponding to the operation are generated by keyboard-musical-tone-signal-generating circuit 52.

When the performer wants to stop the rhythm after the performance, he operates on operation panel 20 to send the rhythm-stop command to CPU 72. The stop-request event is detected at steps 101 and 102 in FIG. 5, and the process proceeds to step 109 via step 103. At step 109, the stop routine shown in FIG. 9 is executed.

At step 351 in FIG. 9, flag RUN is tested whether it is "1" or not. If the test result is "NO", the process exits the stop routine and returns to the main routine in FIG. 5. However, since the test result is "YES" in this case, the process proceeds to step 352 at which the flag RUN is set to "0". Consequently, even when the rhythm-interrupt routine in FIG. 7 is initiated by the tempo clock pulse, the test result at step 250 becomes "NO" and the rhythm-interrupt routine is bypassed, so that any process of the rhythm-interrupt routine including the generation of rhythm tones will not be executed.

At step 353 in FIG. 9, auto-play-write flag APW is tested whether it is "1" or not. If the test result is "NO", the process proceeds to step 354 at which auto-play-read flag APR is tested whether it is "1" or not. Since the test result at step 354 is "NO" in this case, the process exits the stop routine and returns to the main routine in FIG. 5, and a performance in the Normal Performance Mode has been completed.

(2) AUTO-PLAY-WRITE MODE

The electronic musical instrument of the embodiment can also operate in the Auto-Play-Write Mode. In the Auto-Play-Write Mode, when the performer plays on keyboard 10*a*, the performance data produced are simultaneously stored into performance-data memory 62.

The operation of the Auto-Play-Write Mode will be described below.

First, the performer selects a rhythm in the same manner as in the Normal Performance Mode described above, and then commands the CPU 72 to enter into Auto-Play-Write Mode using operation panel 20. The command is detected at steps 101 and 102 in FIG. 5 and the process proceeds to step 110 via step 103. At step 110, auto-play-write flag APW and flag RUN are set to "1", while tempo counter TCNT and address data ADR are set to "0". At step 111, address data ADR is incremented by 1 and the electronic musical instrument enters into Auto-Play-Write Mode.

When flag RUN is set to "1", the rhythm-interrupt routine in FIG. 7 entered by occurrences of the tempo clock pulses, counts the tempo clock pulses. Hence, tempo counter TCNT contains the number of tempo clock pulses occurring from the beginning of the bar to the current position therein. At the same time, rhythm-tone-signal-generating circuit 51 begins to generate rhythm tones corresponding to tempo counter TCNT.

Next, when the performer operates keyboard unit 10, the key/tone-color-event routine shown in FIG. 8 is initiated. Since auto-play-write flag APW is set to "1" in this case, the test result at step 304 is "YES", and the process proceeds to step 306 at which the content of tempo counter TCNT is stored as the timing data to the memory location in performance memory 62 to which address data ADR points (the data stored in the memory location is called performance data APM(ADR) hereafter). The content of tempo counter TCNT denotes, as mentioned above, the number of tempo clock pulses occurring from the beginning of a bar to the current position therein. At step 307, address data ADR is incremented by 1, and at step 308, each of event data is taken out from the event-buffer registers one by one and the identification mark corresponding thereto is added, being stored into performance-data memory 62 as performance data APM(ADR). At step 309, the event-buffer registers from which the event data are removed at step 308 are cleared. At step 310, the event-buffer registers are tested whether any event data remain unremoved. If the test result is "YES", the process loops back to step 307. Thus, in Auto-Write Mode, the event data entered into the event-buffer registers at step 301 are taken out one after another, and are sequentially stored to performance-data memory 62 as performance data APM(ADR) each time address ADR is incremented by 1. When all the event data are taken out from the event-buffer registers, the test result at step 310 becomes "NO", and the process proceeds to step 311 where address ADR is incremented by 1. Thus, the key/tone-color-event routine is completed and the process returns to the main routine shown in FIG. 5. When keyboard unit 10 and/or the operation member for setting a tone color are operated, the key/tone-color-event routine is entered to repeat the above processes.

As described above, each time keyboard unit 10 and/or operation members for setting tone colors are operated, the key/tone-color-event routine is initiated and the musical tones corresponding to the operation are generated in keyboard-musical-tone-signal-generating circuit 52, as well as the performance data are sequentially stored into performance-data memory 62.

When terminating the performance, the performer commands CPU 72 to stop the rhythm by operating on operation panel 20. The command is detected at steps 101 and 102 in FIG. 5, and the process proceeds via step 103 to step 109 at which the stop routine shown in FIG. 9 is entered into. At step 351 in FIG. 9, flag RUN is tested whether it is "1" of not. Since flag RUN is "1" in this case, the test result is "YES", and the process proceeds to step 352 in which flag RUN is cleared to "0". As a result, when the rhythm-interrupt routine in FIG. 7 is entered, any process thereof including the generation of the rhythm tones is not performed. At step 353 in FIG. 9, auto-play-write flag APW is tested if it is "1". Since the test result is "YES" in this case, the process proceeds to step 356 in which the end code that designates the termination of the performance is stored as performance data APM(ADR). At step 357, address ADR is cleared to "0", and at step 358 flag APW is set to "0". At step 354, auto-play-read flag APR is tested whether it is "1" or not. Since the test result is "NO" in this case, the process exits the stop routine and returns to the main routine in FIG. 5.

(3) AUTO-PLAY MODE

In Auto-Play Mode, the performance data stored in performance-data memory 62 are sequentially read, and thereby an automatic performance is carried out. The operation in the Auto-Play Mode will be described below.

First, the performer commands CPU 72 to begin the Auto-Play by manipulating operation panel 20. The command is detected at steps 101 and 102 in FIG. 5, and the process proceeds via step 103 to step 112 at which auto-play-read flag APR and flag RUN are set to "1", while tempo counter TCNT is reset to "0". At step 113, performance data APM(ADR) is loaded as data RDTIM into performance-data memory 62. Since current address ADR is initialized to the top address in performance-data memory 62 so that the first performance data, that is, the first timing data is loaded at step 113, and the electronic musical instrument enters into Auto-Play Mode.

When the rhythm-interrupt routine in FIG. 7 is initiated by the occurrence of the tempo clock pulse, rhythm tone designated by tempo counter TCNT is generated by rhythm-tone-signal-generating circuit 51 at step 251. At step 252, auto-play-read flag APR is tested whether it is "1" or not, and the process proceeds to step 253 when the test result is "YES".

At step 253, automatic-performance-data-read routine shown in FIG. 10 is started. At step 401 in FIG. 10, step counter NSTEP is incremented by 1. At step 402, a test is performed to determine whether the content of data MSTEP and that of step counter NSTEP are equal or not. If the test result is "YES", the process proceeds to step 403, while if the test result is "NO", the process proceeds to step 409. At step 403, master-track pointer MTP is incremented by 1. At step 404, master-track data MTDM(MTP) is tested whether it is tempo data or not. If the test result is "YES", the process proceeds to step 405, whereas if the result is "NO", the process proceeds to step 406. At step 405, master-track data MTDM(MTP) is loaded as data TPD so that tempo oscillator 40 begins to generate tempo clock pulses according to the tempo designated by data TPD, and the process loops back to step 403. If the test result at step 404 is "NO", the process proceeds to step 406 at which master-track data MTDM(MTP) is tested whether it is step data or not. If the test result is "YES" the process proceeds to step 407, whereas if the test result is "NO" the process loops back to step 403. At step 407, master-track data MTDM(MTP) is loaded into data MSTEP as new step data. At step 408, step counter NSTEP is cleared to "0". Thus, processes through steps 403 to 408 are executed each time the content of step counter NSTEP becomes equal to that of step data MSTEP, so that the contents of master-track-data memory 63 are consecutively read and are used as the new tempo data and step data.

At step 409, the content of tempo counter TCNT is tested whether it is equal to data RDTIM, i.e., whether the current timing is the read timing of the performance data from performance-data memory 62 or not. If the test result at step 409 is "NO", the automatic-performance-data-read routine is completed, and the process returns to the rhythm-interrupt routine in FIG. 7, whereas if the test result at step 409 is "YES", the process proceeds to step 410 at which address ADR is incremented by 1. At step 411, performance data APM-(ADR) is loaded as data RDDT. At step 412, data RDDT is tested whether it is timing data or not. If the test result at step 412 is "YES", the process proceeds to step 413; whereas if the test result is "NO", the process proceeds to step 414. At step 413, the content of data RDTIM is updated to that of data RDDT. After that, the process exits the automatic-performance-data-read routine and returns to the rhythm-interrupt routine in FIG. 7. At step 414, to which the process proceeds when the test result at step 412 is "NO", data RDDT is tested whether it is end code or not. If the test result is "YES" the process proceeds to step 416, while if the test result is "NO", i.e., if data RDDT is one of the key-depression data, key-release data or tone-color data, the process proceeds to step 415 at which data RDDT is supplied to automatic-performance-musical-tone-signal-generating circuit 53. As a result, automatic-performance-musical-tone-signal-generating circuit 53 generates musical tones, or stops generating musical tones, or changes tone colors according to supplied data RDDT. On the other hand, if the test result at step 414 is "YES", auto-play-read flag APR and flag RUN are cleared to "0" at step 416, and the process exits the automatic-performance-data-read routine, completing the Auto-Play Mode. In other words, flag APR of "0" prevents the rhythm-interrupt routine in FIG. 7 from executing the automatic-performance-data-read routine, and flag RUN of "0" prevents the rhythm-interrupt routine from running.

When the automatic-performance-data-read routine is completed and CPU 72 returns to the rhythm-interrupt routine, CPU 72 executes steps after step 254 in FIG. 7. Tempo counter TCNT is incremented by 1 at step 254, and is cleared to "0" at step 256 when the content thereof reaches the end value of a bar (at step 255).

Thus, in Auto-Play Mode, each tempo clock pulse causes the rhythm-interrupt routine to start first, and then, causes the automatic-performance-data-read routine to begin. The automatic-performance-data-read routine increments step counter NSTEP at step 401, and sets the new tempo data and step data, each time step counter NSTEP reaches data MSTEP. Each time the content of tempo counter TCNT agrees with read-timing data RDTIM previously read, the performance data is read so that the automatic performance is carried out according to the performance data, until the end code is read.

(4) MASTER-TRACK-WRITE MODE

In the Master-Track-Write Mode, master-track data are written into master-track-data memory 63.

The Master-Track-Write Mode is entered when the performer, by use of mouse **20*b*, designates "Master-Track-Write Mode" in the operation menu displayed on the screen of display unit 20*a*. More specifically, when the performer takes the action above, the master-track-write-request event is detected at steps 101 and 102 of the main routine in FIG. 5, and the process proceeds to step 114 via step 103**.

At step 114, the master-track-write routine in FIG. 11 is entered. At step 451 in FIG. 11, master-track pointer MTP is initialized to "1". At step 452, the time-data-input process is executed: when the operator enters the time data by operating mouse **20*b*, or the number key-pad or up/down keys on operating-member group 20*c*, CPU 72 adds the identification mark ID to the data to form master-track data MTDM(MTP), and stores master-track data MTDM(MTD) to master-track-data memory 63. At step 453**, master-track pointer MTP is incremented by 1.

At step 454, the message reading "Will you enter the rehearsal mark ?" is displayed on display unit **20*a* to request the judgement of the performer. When the performer enters the answer of "YES" or "NO" by use of operation panel 20, it is detected by CPU 72. If the answer is "YES", the process proceeds to step 455, whereas if the answer is "NO", the process proceeds to step 457. At step 455, the rehearsal-mark-input process is executed: when the performer enters the rehearsal-mark number and selects "Fix" or "Float" of Fix/Float from operation panel 20, CPU 72 adds identification marks ID to these data to form master-track data MTDM(MTP), which are stored to master-track-data memory 63. At step 456**, master-track pointer MTP is incremented by 1.

At step 457, the message reading "Will you enter the tempo data ?" is displayed on display unit **20*a* to request the judgement of the performer. When the performer enters the answer of "YES" or "NO" from operation panel 20, it is detected by CPU 72. If the answer is "YES" the process proceeds to step 458, whereas if the answer is "NO" the process proceeds to step 460. At step 458, tempo-data-input process is executed: when the operator enters the tempo data from operation panel 20, CPU 72 adds the identification mark ID to the data to form master-track data MTDM(MTP), which is stored to master-track-data memory 63. At step 459**, master-track pointer MTP is incremented by 1.

At step 460, the message reading "Will you enter the step data ?" is displayed on display unit **20*a* to request the judgement of the performer. When the performer enters the answer of "YES" or "NO" from operation panel 20, it is detected by CPU 72. If the answer is "YES" the process proceeds to step 461, whereas if the answer is "NO" the process proceeds to step 463. At step 461, the step-data-input process is executed: when the operator enters the step data from operation panel 20, CPU 72 adds the identification mark ID to the data to form master-track data MTDM(MTP), which is stored to master-track-data memory 63. At step 462**, master-track pointer MTP is incremented by 1.

At step 463, the message reading "Will you terminate entering the data ?" is displayed on display unit **20*a* to request the judgement of the performer. When the performer enters the answer of "YES" or "NO" from operation panel 20, it is detected by CPU 72. If the answer is "YES" the process proceeds to step 464, whereas if the answer is "NO" the process loops back to step 454. Consequently, entering of the master-track data is allowed until the performer designates "YES" at step 463. At step 464, "End" mark is stored as master-track data MTDM(MTP) into master-track-data memory 63**. Thus, the master-track routine is completed.

(5) MASTER-TRACK-EDIT MODE

In the Master-Track-Edit Mode, the master-track data stored in master-track-data memory 63 can be edited.

The Master-Track-Edit Mode is entered when the performer, using mouse **20*b*, selects the "Master-Track-Edit Mode" in the operation menu displayed on the screen of display unit 20*a*: when the performer takes the action above, the master-track-edit-request event is detected at steps 101 and 102 of the main routine shown in FIG. 5, and the process proceeds to step 115 via step 103**.

At step 115, the master-track-edit routine shown in FIG. 12 is entered. When the routine is started, all the data MTDM(MTP) in master-track-data memory 63 are copied into text buffer MTDMN(MTPN). When the copy is completed, the contents of text buffer MTDMN(MTPN) are displayed on the screen of display unit **20*a* so that the contents of text buffer MTDMN(MTPN) can be modified. At step 501, the presence of operation events on operation panel 20 is tested. If the test result is "YES" the process proceeds to step 502, whereas if the test result is "NO" the process proceeds to step 503. At step 502, the data in text buffer MTDMN(MTPN) are modified according to the operation of the performer on operation panel 20: when the performer, watching the cursor shown on display unit 20*a*, moves mouse 20*b* and clicks it when the cursor moves to the desired position, the data to be modified is designated; and subsequently new data is entered when the performer operates the number keypad or up/down keys in operation-member group 20*c***.

At step 503, the test is performed to determine whether EXIT operation member in operation-member group **20*c* is turned on or not. If the test result is "YES" the process proceeds to step 506, whereas if the test result is "NO" the process proceeds to step 504. At step 504, the test is performed to determine whether CANCEL operation member in operation-member group 20*c* is turned on or not, and when the test result is "NO" the process loops back to step 501, while if the test result is "YES" the process proceeds to step 505 at which text buffer MTDMN(MTPN) is all cleared to cancel the data modification. Thus, the process of the master-track-edit routine is completed. At step 506, all the data in text buffer MTDMN(MTPN) are stored to master-track-data memory 63**. Thus the modification of master-track data MTDM(MTP) is achieved and the master-track-edit routine is completed.

(6) SONG-TOTAL-DURATION-EDIT MODE

In Song-Total-Duration-Edit Mode, the performer can adjust the duration of a piece of music to be automatically performed to a desired duration without changing the duration of a specified section of the piece. In other words, the performer can change the total duration of the piece while maintaining the performance speed of the specified section.

The Song-Total-Duration-Edit Mode is entered when the performer, using mouse **20*b*, selects the "Song-Total-Duration-Edit Mode" in the operation menu displayed on the screen of display unit 20*a*: when the performer takes the action above, the song-total-duration-edit-request event is detected at steps 101 and 102 of the main routine shown in FIG. 5, and the process proceeds to step 116 via step 103**.

At step 116, the total-duration-computing-and-display routine in FIG. 13 is executed. At step 551 in FIG. 13, master-track pointer MTP, total-fixed-performance-duration data TT1, and total-floating-performance-duration data TT2 are initialized to "0". At step 552, master-track pointer MTP is incremented by 1. At step 553, master-track data MTDM(MTP) is tested whether it designates "Fix" or not. If the test result is "YES" the process proceeds to step 554, whereas if the test result is "NO" the process proceeds to step 555. At step 554, rehearsal flag REH is set to "1" so that master-track data MTDM(MTP) read thereafter are processed as the data belonging to the rehearsal (fixed) section, and the process loops back to step 552.

At step 555, on the other hand, master-track data MTDM(MTP) is tested whether it is tempo data or not. If the test result is "YES" the process proceeds to step 556, whereas if the test result is "NO" the process proceeds to step 557. At step 557, master-track data MTDM(MTP) is tested whether it is step data or not. If the test result is "YES" the process proceeds to step 558, whereas if the test result is "NO" the process proceeds to step 561. At step 561, master-track data MTDM(MTP) is tested whether it is "Float"-designation-rehearsal mark or not. If the test result is "YES" the process proceeds to step 562, whereas if the test result is "NO" the process proceeds to step 563. At step 562, rehearsal flag REH is set to "0" so that master-track data MTDM(MTP) read thereafter is processed as data belonging to the section other than the rehearsal (fixed) section.

If the test result at step 555 is "YES" and the process proceeds to step 556, master-track data MTDM(MTP) is stored as data TPD, and the process loops back to step 552. If the test result at step 557 is "YES" and the process proceeds to step 558, rehearsal flag RES is tested whether it is "1" or not. If the test result is "YES" the process proceeds to step 559, whereas if the test result is "NO" the process proceeds to step 560. At step 559, fixed-performance-duration data T1 is computed by the following equation (1) using data TPD obtained at step 556 (whose content is tempo data) and the number of steps indicated by the step data at step 557.

$$T1 = 60 \times (\text{the number of steps})/(\text{resolution } n \times TPD) \quad (1)$$

where the resolution n indicates the number of the tempo clock pulses corresponding to a quarter note. Fixed-performance-duration data T1 is added to total-fixed-performance-duration data TT1 so that data TT1 is updated, and the process loops back to step 552. At step 560, on the other hand, floating-performance-duration data T2 is computed by the following equation (2) using data TPD obtained at step 556 (whose content is tempo data) and the number of steps indicated by the step data at step 557.

$$T2 = 60 \times (\text{the number of steps})/(\text{resolution } n \times TPD) \quad (2)$$

Floating-performance-duration data T2 is added to total-floating-performance-duration data TT2 so that data TT2 is updated, and the process loops back to step 552. Thus, total-fixed-performance-duration data TT1 is updated when rehearsal flag REH is "1", while total-floating-performance-duration data TT2 is updated when rehearsal flag REH is "0", each time the tempo data and the step data are found in master-track data MTDM(MTP) which are read sequentially from master-track-data memory 63.

If all the test results at steps 553, 555, 557 and 561 are "NO", master-track data MTDM(MTP) is the END mark, and the process proceeds to step 563. At step 563, total-fixed-performance-duration data TT1 and total-floating-performance-duration data TT2 are added to obtain total-performance-duration data TT. At step 564, total-performance-duration data TT (in units of seconds), is converted to the representation of "t1 hours: t2 minutes: t3 seconds", and is displayed on display unit 20*a*. Thus the total-duration-computing-and-display routine is completed.

The total-duration-computing-and-display routine, as described above, sequentially reads master-track data MTDM(MTP) from master-track-data memory 63, computes total-fixed-performance-duration data TT1 and total-floating-performance-duration data TT2, and displays the sum of them (i.e., total-performance-duration data TT) on display unit 20*b*.

When the total-duration-computing-and-display routine is completed, the process proceeds to step 117 in the main routine shown in FIG. 5. At step 117, the total-duration-data-modification routine shown in FIG. 14 is executed. At step 601 in FIG. 14, a test is performed to determine whether an operation event on operation panel 20 occurs. If the test result is "YES" the process proceeds to step 602, whereas if the test result is "NO" the process proceeds to step 603. At step 602, CPU 72 reads time data t1, t2 and t3 when the performer enters the altered total-performance-duration data t1 hours, t2 minutes, and t3 seconds, using mouse 20*b*, the number keypad, the up/down keys or the side volumes. At step 603, operations member EXIT in operation member group 20*c* is tested whether it is turned on or not. If the test result is "YES"the process proceeds to step 604, whereas if the test result is "NO" the process proceeds to step 605. At step 605, operation member CANCEL in operation-member group 20*c* is tested whether it is turned on or mot. If the test result at step 605 is "YES" the process proceeds to step 606, whereas if the test result is "NO" the process loops back to step 601. At step 606, data t1, t2, and t3 are cleared and the display thereof on display unit 20*a* are erased, so that the modification of the total-performance duration is canceled. Thus, the total-duration-data modification routine is completed. At step 604, on the other hand, data t1, t2, and t3 entered by the performed are converted to new total-performance-duration data TTN sec. so that the modification of the total-performance duration is achieved. The new total-performance-duration data TTN is displayed on display unit 20*a* in the form of t1 hours t2 minutes t3 seconds. Thus, the total-duration-data-modification routine is completed, and the process proceeds to step 118 of the main routine shown in FIG. 5.

At step 118 in FIG. 5, the tempo-data-modification routine in FIG. 15 is entered. At step 650 in FIG. 15, master-track pointer MTP is cleared to "0". At step 651, master-track pointer MTP is incremented by 1. At step 652, master-track data MTDM(MTP) is tested whether it is a "Fix"-designating-rehearsal mark or not. If the test result at step 652 is "YES" the process proceeds to step 653, whereas if the test result is "NO" the process proceeds to step 654. At step 653, rehearsal flag REH is set to "1" so that master-track data MTDM(MTP) read thereafter is processed as the data belonging to the rehearsal (fixed) section, and the process loops back from step 653 to step 651.

At step 654, master-track data MTDM(MTP) is tested whether it is the tempo data or not. If the test result is "YES" the process proceeds to step 655, whereas if the test result is "NO" the process proceeds to step 656. At step 656, master-track data MTDM(MTP) is tested to determine whether it is the step data or not. If the test result at step 656 is "YES" the process proceeds to step 657, whereas if the test result is "NO" the process proceeds to step 659. At step 659, master-track data MTDM(MTP) is tested whether it is a Float-designating-rehearsal mark or not. If the test result at step 659 is "YES" the process proceeds to step 660, whereas if the test result is "NO" the process proceeds to step 661. At step 660, rehearsal flag REH is set to "0" so that master-track data MTDM(MTP) read hereafter are processed as the data belonging to a floating section (a section other than the rehearsal section).

If the test result at step 654 is "YES" the process proceeds to step 655 at which master-track data MTDM(MTP) (which contains the tempo data) is stored as data TPD, as well as the content of master-track pointer MTP is stored as data MTPI, and the process loops back to step 651. If the test result at step 656 is "YES" the process proceeds to step 657 at which rehearsal flag REH is tested to determine whether it is "1" or not. If the test result at step 657 is "YES" the process loops back to step 651, whereas if the test result is "NO" the process proceeds to step 658. At step 658, $TPD \times (TTN - TT1)/(TT - TT1)$ is computed and the result is stored as new data TPD. In this computation, the following data are used: total-fixed-performance-duration data TT1, total-floating-performance-duration data TT2, and total-performance-duration data TT ($=TT1+TT2$) obtained in the total-duration-computing-and-display routine; new total-performance-duration data TTN entered in the total-duration-data-modification routine; and data TPD obtained at step 655. New data TPD is stored as master-track data MTDM(MTPl) into the location in master-track-data memory 63 to which data MTPl obtained at step 655 points. In other words, master-track data MTDM(MTP) are modified as long as they are the tempo data in the floating sections, and after that the process loops back to step 651.

If the test result at step 659 is "NO" the process proceeds to step 661 at which master-track data MTDM(MTP) is tested whether it is END mark or not. If the test result at step 661 is "YES" the process proceeds to step 662, whereas if the test result is "NO" the process loops back to step 651. At step 662, total-performance-duration data TT is converted into the form of t1 hours, t2 minutes, and t3 seconds, which is displayed on display unit 20*a*. Thus, the tempo-data-modification routine is completed.

As described above, in the tempo-data-modification routine, master-track data MTDM(MTP) are sequentially read from master-track-data memory 63, and are multiplied by a constant as long as the data MTDM(MTP) are the tempo data in the floating sections so that the total-performance duration becomes equal to the value entered in the total-duration-data-modification routine.

Thus, the process at steps 116, 117, and 118 in FIG. 5 yields new master-track data MTDM(MTP) in master-track memory 63, which corresponds to the desired performance duration. The automatic performance, started in this state, will be completed in the desired duration without varying the tempo of the specified sections (rehearsal sections) designated by the performer.

Although a specific embodiment of an automatic performance apparatus constructed in accordance with the present invention has been disclosed, it is not intended that the invention be restricted to either the specific configuration or the uses disclosed herein. Modifications may be made in a manner obvious to those skilled in the art. For example:

(a) Although the tempo data in master-track data MTDM(MTP) are modified to adjust the performance duration in the embodiment described above, a similar effect can also be obtained by modifying the timing data in the floating sections. The timing data, corresponding to the duration of notes, are included in performance data APM(ADR) stored in performance-data memory 62.

(b) Although the content of tempo counter TCNT is directly stored into performance-data memory 62 as the timing data at step 306 in FIG. 8 in the embodiment above, the content of tempo counter TCNT which includes the variable durations of key operations can be corrected before storing to the precise duration of corresponding notes so that the timing auto correction can be achieved.

(c) Although the writing of the performance data into performance-data memory 62 is carried out by actually playing keyboard unit 10 in the embodiment, the performance data can also be written in other ways. For example, using keys provided for entering the tone pitches and duration of notes, the performer can enter the performance data of a piece of music.

(d) Although the performance data are stored to performance-data memory 62 according to the progress of a piece of music in the embodiment, the memory format of the performance data is not limited thereto. For example, the memory format shown in the Japanese Patent Publication No. Sho 58-2890 can be applied so that each note (tone pitch and duration) of a piece can be classified according to its kind with the time of appearance in the performance.

Accordingly, it is intended that the invention be limited only by the scope of the appended claims.

What is claimed is:

1. An automatic performance apparatus having performance-data-memory means which stores performance data of a piece of music, and automatically performing the piece of music by sequentially reading said performance data from said performance-data-memory means, said automatic performance apparatus comprising:

section-designation means for designating a specific section in said piece;

time-evaluating means for counting performance duration of said piece;

performance-duration-modification-designation means for designating performance duration of said piece; and modification means for modifying one of the duration of said specific section and the duration of a section other than said specific section by modifying one of the tempo of said automatic performance and duration of notes of said performance data according to said performance duration counted by said time-evaluating means and said performance duration designated by said performance-duration-modification-designation means, so that said performance duration of said automatic performance becomes equal to said performance duration designated by said performance-duration-modification-designation means.

2. An automatic performance apparatus according to claim 1, wherein said performance data are entered by use of a keyboard.

3. An automatic performance apparatus according to claim 2, wherein said performance data are formed after correcting the duration of the notes entered from said keyboard.

4. An automatic performance apparatus according to claim 1, wherein said performance data are entered by use of keys that designate pitches and duration of notes.

5. An automatic performance apparatus according to claim 1, wherein said performance data are stored in said performance-data-memory means consecutively according to the sequence of notes in said piece.

6. An automatic performance apparatus according to claim 1, wherein said performance data are stored in said performance-data-memory means according to the types of notes in said performance data with the time of appearance in said piece.

7. An automatic performance apparatus according to claim 1, wherein said time-evaluating means counts the total duration TT1 of said specific sections and the total duration TT of said piece, said performance-duration-modification-designation means designating new total duration TTN of said piece in which said piece is to be performed, and said modification means modifying said duration of said sections other than said specific sections by multiplying a constant (TTN−TT1)/(TT−TT1) to the duration thereof.

* * * * *